US008172738B2

(12) United States Patent
Smeenk

(10) Patent No.: US 8,172,738 B2
(45) Date of Patent: May 8, 2012

(54) DEAD-SHAFT ROLLER WITH AEROSTATIC ROTARY UNION

(75) Inventor: Lars A. Smeenk, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 963 days.

(21) Appl. No.: 12/159,806

(22) PCT Filed: Jan. 15, 2007

(86) PCT No.: PCT/US2007/001081

§ 371 (c)(1),
(2), (4) Date: Jul. 1, 2008

(87) PCT Pub. No.: WO2007/084480

PCT Pub. Date: Jul. 26, 2007

(65) Prior Publication Data

US 2009/0011912 A1 Jan. 8, 2009

Related U.S. Application Data

(60) Provisional application No. 60/759,714, filed on Jan. 18, 2006.

(51) Int. Cl.
*F28F 5/02* (2006.01)
*F16L 27/00* (2006.01)

(52) U.S. Cl. ..... 492/46; 285/121.1; 165/90

(58) Field of Classification Search ..... 165/89–90; 285/123.1, 121.1, 121.3, 121.5, 121.6, 122.1, 285/213.16, 123.16; 492/20, 46
See application file for complete search history.

(56) References Cited

U.S. PATENT DOCUMENTS 2,577,858 A * 12/1951 Sampson ..... 92/106
2,662,785 A * 12/1953 Fawick ..... 285/121.5
3,086,279 A * 4/1963 Alexeff ..... 492/6
3,776,070 A * 12/1973 Stoffels ..... 82/52
4,050,510 A * 9/1977 Theysohn ..... 165/89
4,055,220 A 10/1977 Stelwagen
4,459,726 A * 7/1984 O'Brien et al. ..... 492/7
4,955,433 A * 9/1990 Zaoralek ..... 165/89
(Continued)

OTHER PUBLICATIONS

Professional Instruments Company, Hopkins, Minnesota, 2 website pages showing air bearings available, retrieved from internet Sep. 25, 2008, www.airbearings.com.

*Primary Examiner* — David Bryant
*Assistant Examiner* — Jacob Cigna
(74) *Attorney, Agent, or Firm* — Douglas B. Little

(57) ABSTRACT

A dead-shaft roller having a shaft and a roll with a fluid circulation passage therein, and at least two bearings support the roll on the shaft. A rotary union is positioned at at least one end of the roll, possibly both. The rotary union has a rotatable sleeve and a non-rotating sleeve. The rotatable sleeve has a fluid conducting path therein, such that the fluid conducting path is in fluid communication with the fluid circulation passage in the roll. The non-rotating sleeve is positioned adjacent and internal to the rotatable sleeve. The non-rotating sleeve has a first fluid port therein such that the fluid conducting path is in fluid communication with the first fluid port at a first fluid transfer zone. At least two air bearings are present, mounted between the rotatable sleeve and the non-rotating sleeve, such that the air bearings are on opposite sides of the first fluid transfer zone.

6 Claims, 2 Drawing Sheets

U.S. PATENT DOCUMENTS 4,964,202 A * 10/1990 Pav et al. ..... 492/7
5,022,686 A * 6/1991 Heel et al. ..... 285/121.4
5,152,333 A * 10/1992 Barbe et al. ..... 164/423
5,778,971 A 7/1998 Szam
5,843,282 A * 12/1998 Schmitt et al. ..... 162/272
6,164,316 A 12/2000 Betti
6,683,284 B2 1/2004 Nyman et al.
6,862,983 B2 * 3/2005 Bornhorst ..... 100/282
7,080,592 B2 * 7/2006 Clark et al. ..... 92/106
7,399,001 B2 * 7/2008 Maier ..... 285/121.4

* cited by examiner

DEAD-SHAFT ROLLER WITH AEROSTATIC ROTARY UNION

CROSS-REFERENCE TO RELATED APPLICATION

This application claims the benefit of U.S. Provisional Patent Application Ser. No. 60/759,714, filed Jan. 18, 2006, entitled "Dead-Shaft Roller with Aerostatic Rotary Union", which application is hereby incorporated by reference in its entirety.

TECHNICAL FIELD

The present invention is related to rollers for the support of indefinite length webs, and more particularly to dead-shaft idler rollers that include temperature control.

BACKGROUND

In recent years the fabrication of products in the form of, or conversion from, an indefinite length web of material has become a popular method of manufacture whenever the product lends itself to such methods. High production rates and lower costs are often obtained when web based manufacturing can be used. A well-developed art has grown up around the need for moving and handling indefinite length webs when such web based methods are used.

Dead-shaft idler rollers are commonly used to support and/or deflect indefinite length webs during production processes. It is usually desirable to construct such idler rollers to present minimal rotational friction to the web being supported. Energy losses caused by rotational friction in the idler roller must be made up by the transfer of kinetic energy from the web to the idler roller. This is undesirable for several reasons, including the possibility of loss of precision tension control over the web.

Dead-shaft idler rollers are generally preferred over similar live-shaft rollers for various reasons. Dead-shaft rollers have less roll face deflection than a similar live-shaft design because its bearings are located in headers, i.e. closer to the center of the roll. Precision grinding of a dead-shaft roll is typically less complicated than for a live-shaft roll of comparable size and capacity in terms of mounting, aligning, and driving the roll in the grinding machine. Additionally, it is easier to mount and maintain the alignment of dead-shaft rollers on manufacturing equipment than live-shaft rollers.

Another type of roller also often used in web-based manufacturing is a temperature controlled roller. In some processes, it is desirable to add or remove thermal energy from the web at some stage of production processes. Electrical heaters can be used to impart energy (heat). However, rolls that are heated or cooled by fluid are also known to the art and have their advantages over electrically heated rollers. For example, water is a very efficient and safe medium to transfer heat to a web. Fluid or water heated rolls can be controlled more responsively than electrically heated rolls. Further, fluid such as water can both heat and cool relative to room temperature. There are numerous expedients discussed in literature that allow fluid to be circulated through a temperature controlled roller while it is spinning. However, these expedients all pertain to live-shaft rollers. The art would be well served by the discovery of the mechanism by which the advantages of fluid-based temperature-controlled rollers could be combined with the advantages of dead-shaft rollers.

SUMMARY

Embodiments of the present invention address these issues by providing a dead-shaft roller that includes a rotary union for transferring fluid to the roll even while the roll is spinning. One of the features that appears in preferred embodiments of this invention is that the air, used in the air bearings to reduce friction between moving parts within the rotary union, also seals leakage of fluid.

In one respect, the invention is a dead-shaft roller having a shaft and a roll with a fluid circulation passage therein for flow of heating or cooling fluid. At least two bearings support the roll on the shaft. A rotary union is positioned at least one end of the roll; sometimes a rotary union is positioned at each end. The rotary union includes a plurality of fluid paths or passages therein, to control the flow of the heating or cooling fluid. In some embodiments, the rotary union has a rotatable sleeve and a non-rotating sleeve. The rotatable sleeve has a fluid conducting path therein, in fluid communication with the fluid circulation passage in the roll. The non-rotating sleeve is positioned adjacent the rotatable sleeve, usually internal to the rotatable sleeve, and has a first fluid port therein, the first fluid port being at a first fluid transfer zone and in fluid communication with the fluid conducting path of the rotatable sleeve. In most embodiments, at least two air bearings are present, mounted between the rotatable sleeve and the non-rotating sleeve and positioned on opposite sides of the first fluid transfer zone.

The rotary union and its various passages and ports may supply or recover the fluid used for temperature control. In many preferred embodiments, the rotary union both supplies and recovers the fluid. In such embodiments, the roll also has a fluid return passage for returning fluid that has passed through the fluid circulation passage. Additionally, the non-rotating sleeve has a second fluid port at the rotary union that is a fluid outlet, and the rotatable sleeve has a fluid return conduit therein, such that the fluid return conduit is in fluid communication with the fluid return passage. In parallel with the discussion above, the fluid return conduit is in fluid communication with the second fluid port at a second fluid transfer zone. For best results, the air bearings are positioned on opposite sides of the second fluid transfer zone.

In some embodiments, the roll may be configured as multiple (e.g., two or three) nested shells so that, for example, the first and the second shell that together define the fluid circulation passage. In such designs, it is often advantageous for the second and a third shell to together define the fluid return passage.

When using a dead-shaft roller according to the present invention, it is usually desirable to provide at least one support for the shaft that is adapted to accommodate the expected thermal expansion of the shaft during operation.

DETAILED DESCRIPTION

Figure 1:
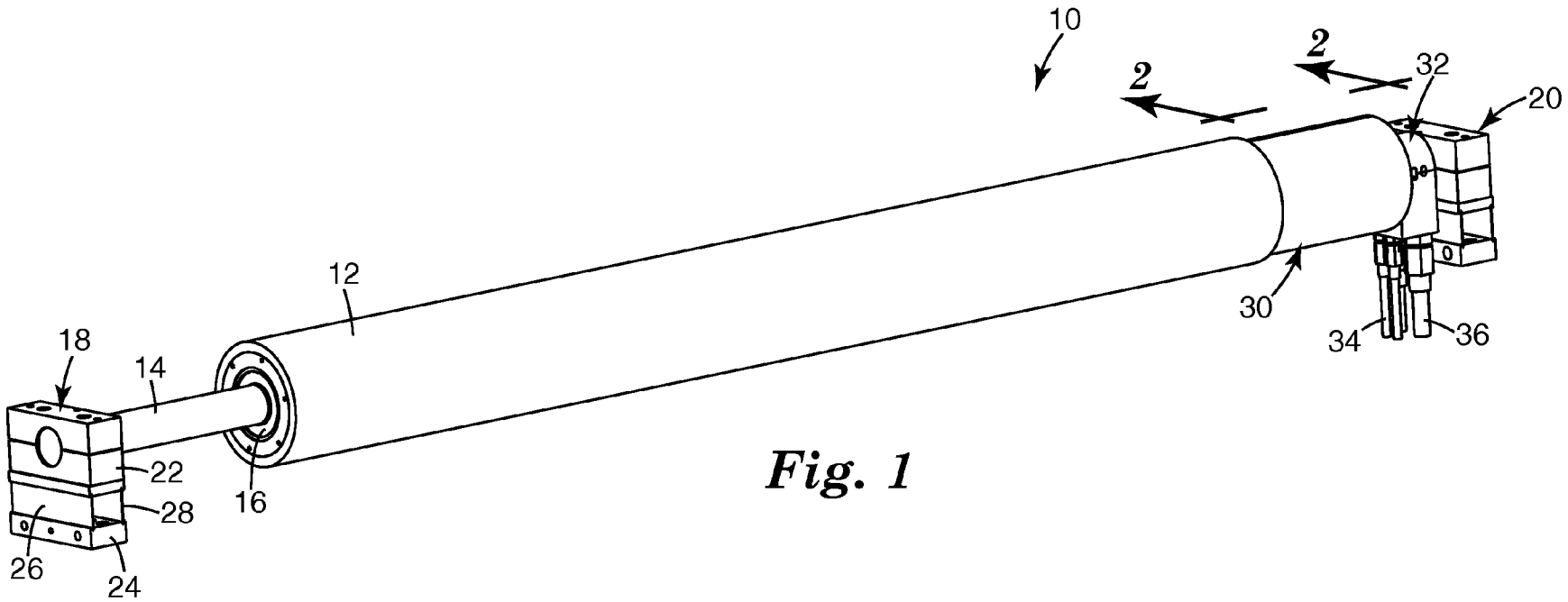
FIG. 1 shows a perspective view of a dead-shaft roller according to the present invention.

Referring now to FIG. 1, a perspective view of a dead-shaft roller according to the present invention is illustrated. The dead-shaft roller 10 includes a roll 12 mounted on a dead shaft 14. At least one bearing 16, usually at least two bearings 16, support the roll 12 of the dead shaft 14; only one bearing 16 is visible in FIG. 1. The bearings 16 are conveniently rolling element bearings, although other types will also prove suitable. Many preferred embodiments of the dead-shaft roller 10 have the dead shaft 14 supported by a pair of mounts, such as shaft mounts 18 and 20. The shaft mounts 18, 20 conveniently include a shaft clamp 22 capable of accommodating thermal expansion in the dead shaft 14. The shaft clamp 22 is conveniently attached to a flexural mount 24, such as by two bending members 26 and 28.

The dead-shaft roller 10 also has a rotary union 30 at least one end of the roll 12. As the reader will discern in connection with the discussion below, the invention can be prepared with a rotary union at one or both ends of the roll 12. Embodiments having a rotary union 30 at each end are simpler to construct in some ways, more difficult in other ways, but on balance, tend to be more expensive than the illustrated embodiment with one union 30. The illustrated embodiment also conveniently includes a manifold 32 for the connecting of air and fluid to the rotary union 30 via air hoses 34 and fluid hoses 36, as desired.

Roll 12, together with rotary union 30, provide fluid flow through roll 12 to heat or cool dead-shaft roller 10, as desired.

Figure 2:
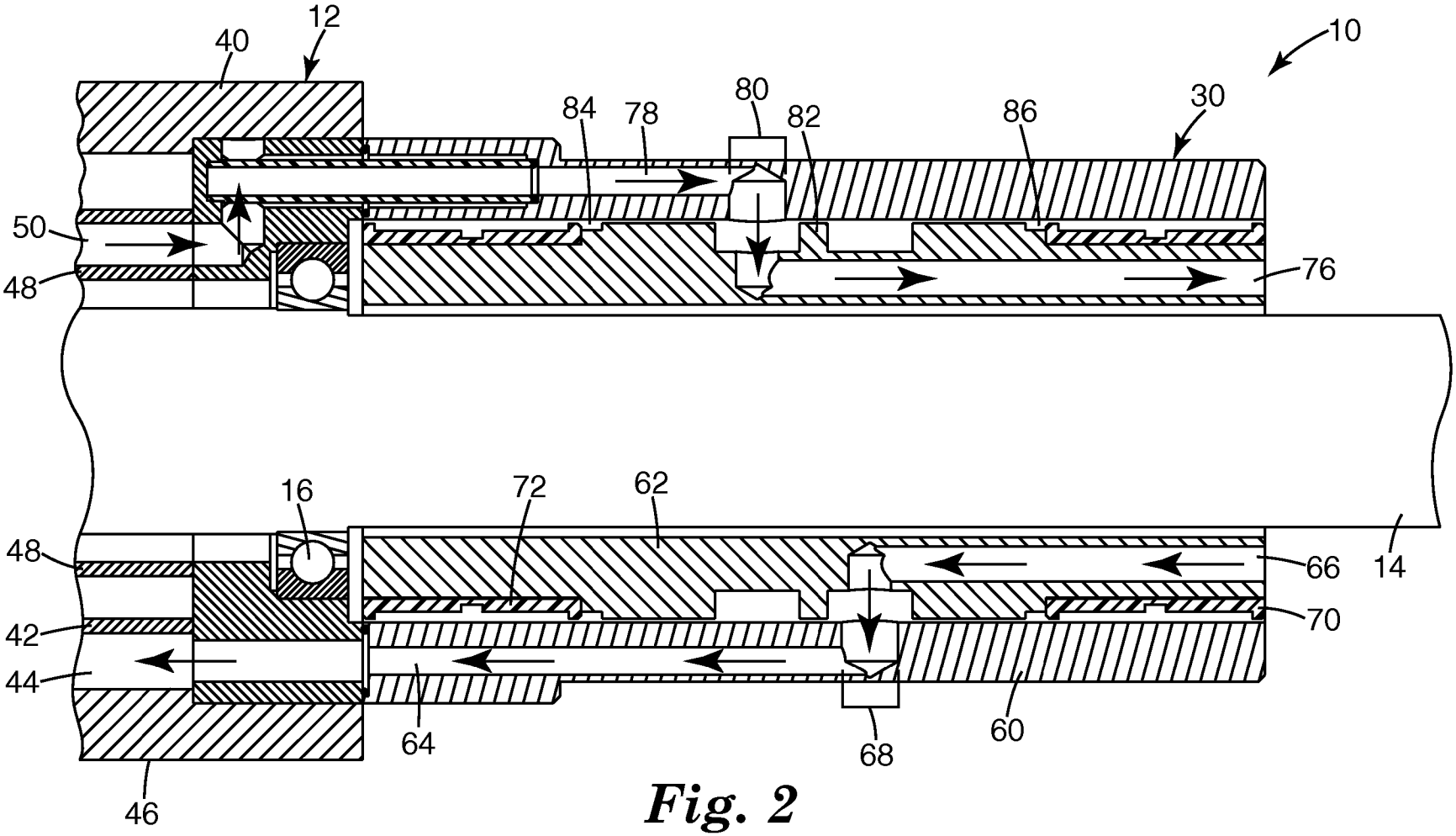
FIG. 2 shows a cross-section view of the dead-shaft roller, taken along section lines 2-2 of FIG. 1.

Referring now to FIG. 2, a cross-section view of the dead-shaft roller 10, taken along section lines 2-2 of FIG. 1, is illustrated. For clarity, the manifold 32 of FIG. 1 has been removed. The illustrated roll 12 has a first shell 40 and a second shell 42 that together define a fluid circulation passage 44. Fluid moving through the fluid circulation passage 44 serves to regulate the temperature of the outer surface 46 of first shell 40. The illustrated embodiment also has a third shell 48 internal to the first and second shells 40, 42, such that the second shell 42 and the third shell 48 together define a fluid return passage 50. The efficiency of the thermal transfer from roll 12 to web is usually enhanced if the fluid circulation passage 44 and/or the fluid return passage 50 (if present) are constructed in the form of a spiral annulus around roll 12.

Adjacent to at least one end of the roll 12 is the rotary union 30, which includes a rotatable sleeve 60 that is attached to and rotates with the roll 12, and non-rotating sleeve 62 adjacent to and positioned interior to the rotatable sleeve 60. The rotatable sleeve 60 has at least one fluid conducting path 64 therein, such that the fluid conducting path 64 is in fluid communication with the fluid circulation passage 44 defined by shells 40 and 42. The non-rotating sleeve 62 has a first fluid port 66 therein, and the fluid conducting path 64 is in fluid communication with the first fluid port 66 at a first fluid transfer zone 68. It is usually convenient for the first fluid transfer zone 68 to extend around at least a portion of, and at least a good bit of, the circumference of the rotatable sleeve 60 and non-rotating sleeve 62.

The rotary union 30 has at least one air bearing, in this embodiment at least two air bearings 70 and 72 longitudinally mounted along shaft 14 between the rotatable sleeve 60 and the non-rotating sleeve 62, with air bearings 70, 72 positioned on opposite sides of the first fluid transfer zone 68. The presence of the air bearings 70, 72 in these positions achieves a valuable end in that the air pressure within the air bearings accomplishes two functions: air pressure floats the non-rotating sleeve 62 for easy motion relative to the rotatable sleeve 60; and, contains the fluid in the first fluid transfer zone 68.

The illustrated rotary union 30 is adapted not only for conveying fluid into the fluid circulation passage 44, but also for collecting that fluid returning from the roll 12 via the fluid return passage 50. Accordingly, the non-rotating sleeve 62 has a second fluid port 76 that is generally used as an outlet for fluid that has circulated through the roll 12. Similarly with the structures noted above, the rotatable sleeve 60 has a fluid return conduit therein 78, such that the fluid return conduit 78 is in fluid communication with the fluid return passage 50. Also similarly, the fluid return conduit 78 is in fluid communication with the second fluid port 76 at a second fluid transfer zone 80. Once again, the air bearings 70, 72 are on opposite sides of the second fluid transfer zone 80.

In many preferred embodiments, a water barrier annulus 82 is present, conveniently sized (e.g., ground) to a diameter just slightly less than the inside diameter of the rotatable sleeve 60. Extra effort on precision grinding at this point facilitates separation of the exchanges going on in first fluid transfer zone 68 and second fluid transfer zone 80.

Conveniently, a first and a second exhaust grooves 84 and 86 (e.g., for air and/or water) are present to collect and remove the small amount of water that might leak through the tight clearance between the rotatable sleeve 60 and the non-rotating sleeve 62.

In many preferred embodiments, the non-rotating sleeve 62 is loosely restrained from longitudinal movement, i.e., parallel to the long axis of dead shaft 14. Any number of mechanical expedients can serve to accomplish this, including a radially extending flange mounted on the dead-shaft 14 just outboard of the end of non-rotating sleeve 62.

Dead-shaft roller 10, configured for fluid passage therethrough to heat or cool surface 46, as desired, is configured for moving indefinite lengths of web material during processing. The operation of roller 10 generally is no different from operation of conventional dead-shaft rollers, other than supplying and feeding fluid (e.g., water) to the various paths and passages, even while roll 12 is spinning.

While the invention has been particularly shown and described with reference to various embodiments thereof, it will be understood by those skilled in the art that various other changes in the form and details may be made therein without departing from the spirit and scope of the invention.

What is claimed is:

1. A roller system, comprising:

a dead-shaft;

a roll having a fluid circulation passage therein;

at least two bearings supporting the roll on the dead-shaft;

a rotary union at at least one end of the roll, the rotary union comprising a rotatable sleeve having a fluid conducting path therein, such that the fluid conducting path is in fluid communication with the fluid circulation passage;

a non-rotating sleeve adjacent the rotatable sleeve, the non-rotating sleeve having a first fluid port therein such that the fluid conducting paths are in fluid communication with the first fluid port at a first fluid transfer zone;

at least two air bearings mounted between the rotatable sleeve and the non-rotating sleeve, such that the air bearings are on opposite sides of the first fluid transfer zone.

2. The system according to claim 1 wherein the roll further comprises a fluid return passage for returning fluid from the fluid conducting path, and wherein the non-rotating sleeve has a second fluid port therein, the rotatable sleeve has a fluid return conduit therein, such that the fluid return conduit is in fluid communication with the fluid return passage, and also such that the fluid return conduit is in fluid communication with the second fluid port at a second fluid transfer zone, such that the air bearings are on opposite sides of the second fluid transfer zone.

3. The system according to claim 1 wherein the bearings are rolling element bearings.

4. The system according to claim 1 further comprising at least one support for the dead-shaft adapted to accommodate thermal expansion of the shaft.

5. The system according to claim 1 wherein the roll comprises a first and a second shell that together define the fluid circulation passage.

6. The system according to claim 5 wherein the roll comprises a third shell such that the second shell and the third shell together define the fluid return passage.

* * * * *